US010720142B2

(12) United States Patent
Bai et al.

(10) Patent No.: US 10,720,142 B2
(45) Date of Patent: Jul. 21, 2020

(54) ACTIVE DUCT NOISE CONTROL SYSTEM AND METHOD THEREOF

(71) Applicant: NATIONAL TSING HUA UNIVERSITY, Hsinchu (TW)

(72) Inventors: Ming-Sian Bai, Hsinchu (TW); Hung-Yu Chen, Tainan (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 0 days.

(21) Appl. No.: 16/238,060

(22) Filed: Jan. 2, 2019

(65) Prior Publication Data

US 2020/0090635 A1 Mar. 19, 2020

(30) Foreign Application Priority Data

Sep. 19, 2018 (TW) ..... 107132975 A

(51) Int. Cl.
*G10K 11/178* (2006.01)

(52) U.S. Cl.
CPC ..... *G10K 11/178* (2013.01); *G10K 2210/112* (2013.01); *G10K 2210/3026* (2013.01); *G10K 2210/3027* (2013.01); *G10K 2210/3045* (2013.01)

(58) Field of Classification Search
CPC ..... G10K 11/178; G10K 2210/112; G10K 2210/3026; G10K 2210/3027; G10K 2210/3045; G10K 2210/12822; G10K 2210/1282
USPC ..... 381/71.5, 71.1
See application file for complete search history.

(56) References Cited

U.S. PATENT DOCUMENTS 6,201,872 B1 * 3/2001 Hersh ..... G10K 11/178 381/71.5
9,923,550 B2 * 3/2018 Argyropoulos .... H03H 21/0012
2003/0219132 A1 * 11/2003 Sommerfeldt ..... G10K 11/178 381/71.14
2004/0114768 A1 * 6/2004 Luo ..... G10K 11/178 381/71.4
2009/0010447 A1 * 1/2009 Waite ..... G10K 11/178 381/71.6

(Continued)

FOREIGN PATENT DOCUMENTS

WO WO-9401981 A2 * 1/1994 ..... H03H 21/0012

*Primary Examiner* — Vivian C Chin
*Assistant Examiner* — Ubachukwu A Odunukwe
(74) *Attorney, Agent, or Firm* — Muncy, Geissler, Olds & Lowe, PC

(57) ABSTRACT

An active duct noise control system and a method thereof are provided, including a duct, a noise source speaker, a microphone, a plurality of noise-cancelling speakers, and a plurality of controllers. Wherein, the noise source speaker generates the primary noise, and the microphone is disposed to receive the residual noise. The plurality of noise-cancelling speakers are disposed between the noise source speaker and the microphone and respectively generate noise-cancelling audio frequencies to offset the primary noise and reduce the residual noise. The plurality of controllers are respectively connected to the plurality of noise-cancelling speakers and the noise source speaker and calculate each of the noise-cancelling audio frequencies generated by each of the plurality of noise-cancelling speakers according to the multi-channel inverse filtering principle.

6 Claims, 7 Drawing Sheets

(56) References Cited

U.S. PATENT DOCUMENTS

| | | | | |
|---|---|---|---|---|
| 2010/0028134 | A1* | 2/2010 | Slapak | F24F 13/24<br>415/119 |
| 2015/0172813 | A1* | 6/2015 | Goto | H04R 3/002<br>381/71.1 |

* cited by examiner

ACTIVE DUCT NOISE CONTROL SYSTEM AND METHOD THEREOF

This application claims priority from Taiwan Patent Application No. 107132975, filed on Sep. 19, 2018, in the Taiwan Intellectual Property Office, the content of which is hereby incorporated by reference in its entirety for all purposes.

FIELD OF THE INVENTION

The present disclosure relates to an active duct noise control system and a method thereof, more particularly to a control system and a method using the multi-channel inverse filtering principle to dispose multi-channel noise-cancelling speakers to provide a more preferable active noise-cancelling effect.

BACKGROUND OF THE INVENTION

Noise has long been an environmental issue that has drawn a great deal of attention. Noise control methods at present may be categorized into two types: Passive noise control and active noise control (ANC). The passive noise control refers to using barriers or sound absorbing materials, such as sound-absorbing cotton, to block the sound source to achieve the effect of cancelling noise. This method emphasizes cancelling high frequency noise, but is not suitable for cancelling noise at low frequencies. However the active noise control complements this disadvantage by using the second sound source to play an anti-noise sound source to cancel a low frequency noise.

The framework of the active noise control may be divided into feedforward control, feedback control, and hybrid control. In terms of the feedforward control framework of the active noise control, usually an adaptive algorithm is used to design a controller, such as using the least-mean-square (LMS) to practice. With the advancement of technology, the input signal, namely the reference signal, has to be filtered by passing through the secondary path to ensure convergence. The FXLMS (filtered-x least-mean-square) algorithm is widely applied to tackle the problem of active noise cancelling. Although using the aforementioned method to design a controller helps find an optimal solution and converge to a certain range, an error still occurs, leading to defects in the accuracy and effectiveness of cancelling noises.

In view of what is mentioned above, conventional active duct noise control systems still have room for improvement. Therefore, the present disclosure aims to improve deficiencies in terms of current techniques by designing an active duct noise control system and a method thereof to make the active noise control more accurate and effective so as to enhance the implementation and application in industries.

SUMMARY OF THE INVENTION

In view of the above-mentioned problems, the present disclosure provides an active duct noise control system and a method thereof. The active duct noise control system including a plurality of noise-cancelling speakers is designed according to the multi-channel inverse filtering principle. Moreover, the active duct noise control method may be performed to minimize the noise-cancelling errors and enhance the noise-cancelling effect.

According to the purpose of the present disclosure, the present disclosure provides an active duct noise control system, including a duct, a noise source speaker, a microphone, a plurality of noise-cancelling speakers, and a plurality of controllers. Wherein, the noise source speaker is disposed on one end of the duct and generates a primary noise. The microphone is disposed on the other end of the duct and receives a residual noise. The plurality of noise-cancelling speakers are disposed between the noise source speaker and the microphone and respectively generate noise-cancelling audio frequencies to offset the primary noise and reduce the residual noise. The plurality of controllers are respectively connected to the plurality of noise-cancelling speakers and the noise source speaker and calculate each of the noise-cancelling audio frequencies generated by each of the plurality of noise-cancelling speakers according to the multi-channel inverse filtering principle.

Preferably, the multi-channel inverse filtering principle may satisfy the equation $g_1[k]*c_1[k]+g_2[k]*c_2[k]+\ldots+g_N[k]*c_N[k]+m[k]=0$. Wherein, m[k] is an impulse response of a primary path (primary noise), g[k] is the impulse response of a secondary path (each of the noise-cancelling audio frequencies), and $c_i[k]$ is a control coefficient of each of the controllers; i=1, 2, . . . , N, N is the number of each of the noise-cancelling speakers, and * is a linear convolution operation.

Preferably, the equation may be converted into a relation in a matrix form:

$$G_1c_1+G_2c_2+\ldots+G_Nc_N=[G_1\ G_2\ \ldots\ G_N]\begin{bmatrix}c_1\\c_2\\\vdots\\c_N\end{bmatrix}=Gc=-m;$$

wherein, $G=[G_1\ G_2\ldots G_N]\in\mathbb{R}^{L_m\times NL_c}$ is an impulse response matrix of the secondary paths and $$c=\begin{bmatrix}c_1\\c_2\\\vdots\\c_N\end{bmatrix}\in\mathbb{R}^{NL_c}$$

is a control coefficient matrix of each of the controllers; m is the impulse response matrix of the primary path, $L_m$ is a matrix length of m, $L_c$ is the matrix length of c, and N is the number of the plurality of noise-cancelling speakers.

Preferably, $L_g$ may be the matrix length of G, and when $(N-1)L_c\geq L_g-1$ is satisfied, a control coefficient of each of the plurality of controllers has a corresponding solution to control the noise-cancelling audio frequencies respectively generated by the plurality of noise-cancelling speakers.

Preferably, the active duct noise control system may further include a spectrum analyzer connected to the noise source speaker and the plurality of noise-cancelling speakers and sampling the impulse response in the duct.

According to the other purpose, the present disclosure provides an active duct noise control method applicable to the primary noise generated by the noise source speaker in the control duct. The duct includes a plurality of noise-cancelling speakers, a plurality of controllers which control a plurality of noise-cancelling speakers, and a microphone. The active duct noise control method includes the following steps: disposing the noise source speaker on one end of the duct and disposing the microphone on the other end of the duct to receive a residual noise; disposing the plurality of noise-cancelling speakers between the noise source speaker and the microphone; connecting the plurality of controllers to the noise source speaker to receive the primary noise and calculating noise-cancelling audio frequencies generated by each of the plurality of noise-cancelling speakers according to a multi-channel inverse filtering principle; and respectively generating each of the noise-cancelling audio frequencies to offset the primary noise and reduce the residual noise by the plurality of noise-cancelling speakers.

Preferably, the multi-channel inverse filtering principle may satisfy the following equation $g_1[k]*c_1[k]+g_2[k]*c_2[k]+\ldots+g_N[k]*c_N[k]+m[k]=0$. Wherein, m[k] is an impulse response of a primary path (primary noise), g[k] is the impulse response of a secondary path (each of the noise-cancelling audio frequencies), and $c_i[k]$ is a control coefficient of each of the controllers; i=1, 2, . . . , N, N is the number of each of the noise-cancelling speakers, and * is a linear convolution operation.

Preferably, the equation may be converted into a relation in a matrix form:

$$G_1c_1+G_2c_2+\ldots+G_Nc_N=[G_1\ G_2\ \ldots\ G_N]\begin{bmatrix}c_1\\c_2\\\vdots\\c_N\end{bmatrix}=Gc=-m;$$

Wherein, $=[G_1\ G_2\ \ldots\ G_N]\in\mathbb{R}^{L_m\times NL_c}$ is an impulse response matrix of each of the secondary paths and $$c=\begin{bmatrix}c_1\\c_2\\\vdots\\c_N\end{bmatrix}\in\mathbb{R}^{NL_c}$$

is a control coefficient matrix of each of the controllers; m is the impulse response matrix of the primary path, $L_m$ is a matrix length of m, $L_c$ is the matrix length of c, and N is the number of the plurality of noise-cancelling speakers.

Preferably, $L_g$ may be the matrix length of G, and when $(N-1)L_c\geq L_g-1$ is satisfied, a control coefficient of each of the plurality of controllers has a corresponding solution to control the noise-cancelling audio frequencies respectively generated by the plurality of noise-cancelling speakers.

Preferably, the active duct noise control method may further sample the impulse response in the duct by a spectrum analyzer connected to the noise source speaker and the plurality of noise-cancelling speakers.

In accordance with the statements as mentioned above, the active duct noise control system and the method thereof in the present disclosure may have one or more of advantages as follows:

(1) The active duct noise control system and the method thereof may utilize the multi-channel inverse filtering principle to calculate the control coefficient of each of the controllers in such a way that the multi-channel noise-cancelling speakers may generate the out-of-phase noise which offset the primary noise to make residual noise approach zero, thus obtaining the optimal noise-cancelling effect.

(2) The active duct noise control system and the method thereof may provide the disposition of the multi-channel noise-cancelling speakers. Compared with the single channel (noise-cancelling speaker) of the conventional techniques, which look for feasible solutions to convergence only by using algorithm, the present disclosure with multiple channels may dispel the primary noise more accurately, thus minimizing the noise-cancelling error.

(3) The active duct noise control system and the method thereof may effectively minimize broadband noise, which may be a solution scheme applied to other active noise-cancelling ducts, fans, or . . . etc, thus realizing various ways of application.

DETAILED DESCRIPTION OF THE ILLUSTRATED EMBODIMENTS

To facilitate the review of the technique characteristics, contents, advantages, and achievable effects of the present disclosure, the embodiments together with the drawings are described in detail as follows. However, the drawings are used only for the purpose of indicating and supporting the specification, which is not necessarily the real proportion and precise configuration after the implementation of the present disclosure. Therefore, the relations of the proportion and configuration of the attached drawings should not be interpreted to limit the actual scope of implementation of the present disclosure.

Figure 1:
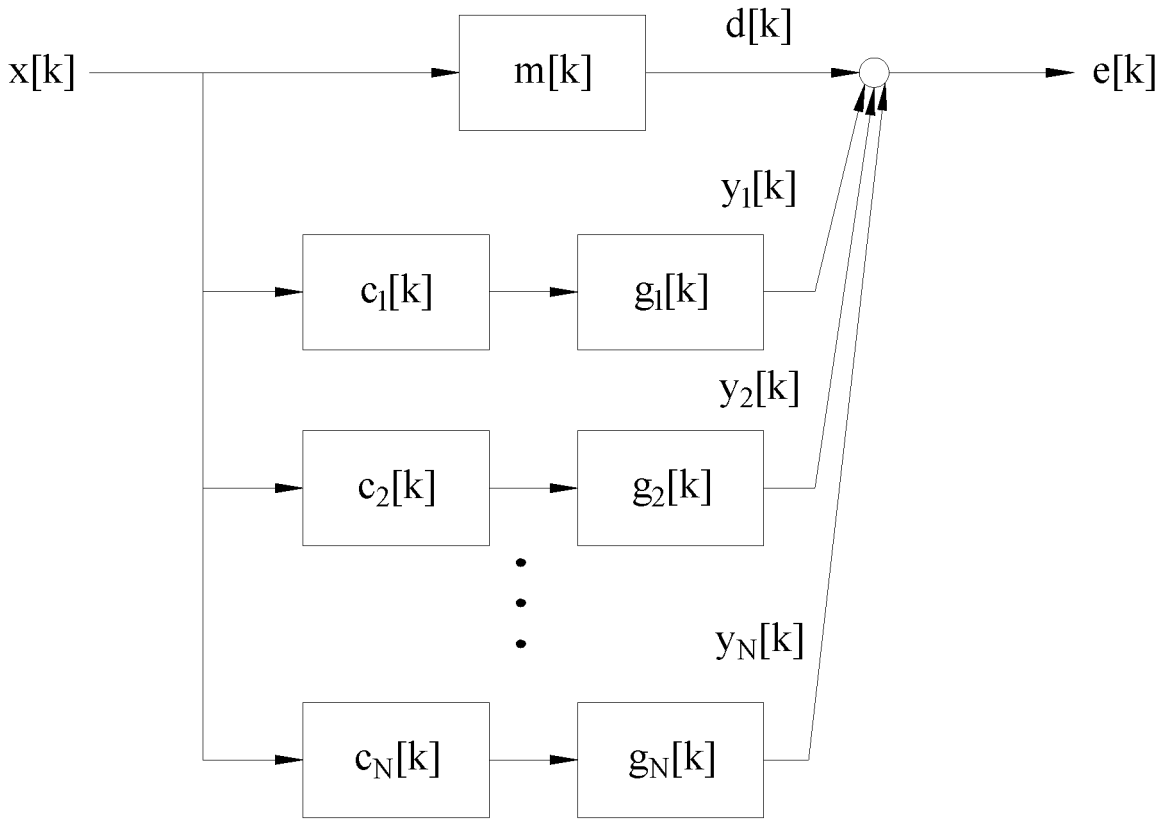
FIG. 1 is a multi-channel framework diagram of the active duct noise control system of an embodiment in the present disclosure.

Please refer to FIG. 1, illustrating the multi-channel framework diagram of the active duct noise control system of the embodiment in the present disclosure. As shown, the active duct noise control system includes the impulse response m[k] of the primary path controlled by the reference signal x[k]. The expectation signal d[k] of the primary noise generated by the noise source speaker may also be the noise source of the primary path. Under the active noise-cancelling principle, the noise-cancelling speakers with N channels are disposed. Similarly, after the reference signal x[k] is received, the first controller may transmit the first control signal $c_1[k]$ to drive the first noise-cancelling speaker to make the impulse response $g_1[k]$ of the secondary path generated thereof become the noise-cancelling audio frequencies $y_1[k]$ which cancels the primary noise. In the same manner, the second controller transmits the second control signal $c_2[k]$ to drive the second noise-cancelling speaker to make the impulse response $g_2[k]$ of the secondary path generated thereof become the noise-cancelling audio frequencies $y_1[k]$ which cancels the primary noise. Until the $N^{th}$ controller transmits the $N^{th}$ control signal $c_N[k]$ to drive the $N^{th}$ noise-cancelling speaker, the impulse response $g_N[k]$ of the secondary path generated thereof becomes the noise-cancelling audio frequencies $y_N[k]$ which cancels the primary noise.

For the purpose of determining the noise-cancelling effect on the primary noise, a microphone may be disposed to receive residual noise frequencies, namely the error signal e[k] of the sum of the multi-channel audio frequencies ($d[k]+y_1[k]+y_2[k]+ \ldots +y_N[k]$). To enhance the noise-cancelling effect, that is, to make the audio signal of the error signal e[k] approach zero, the aforementioned framework may be shown as the equation (1):

$$m[k]+g_1[k]*c_1[k]+g_2[k]*c_2[k]+ \ldots +g_N[k]*c_N[k]=0 \quad (1)$$

Wherein, * calculates the noise-cancelling audio frequencies generated by the noise-cancelling speakers for each channel according to the linear convolution. Under the feedforward control framework of the single channel in the conventional method, the active noise-cancelling may be shown as equation (2).

$$g[k]*c[k]+m[k]=0 \quad (2)$$

Wherein m[k] is the impulse response of the primary path, g[k] is the impulse response of each of the secondary paths, c[k] is the control coefficient of each of the controllers, and * is the linear convolution operation.

In the previous calculation regarding a single channel, the linear convolution operation as mentioned above may be converted into a matrix form, for example, converting the operation thereof into the following equation:

$$\begin{bmatrix} g[0] & 0 & 0 \\ g[1] & g[0] & \vdots \\ \vdots & g[1] & \\ g[L_g-1] & \vdots & 0 \\ 0 & g[L_g-1] & g[0] \\ \vdots & \ddots & g[1] \\ \vdots & & \vdots \\ 0 & \ldots & g[L_g-1] \end{bmatrix} \begin{bmatrix} c[0] \\ c[1] \\ \vdots \\ c[L_c-1] \end{bmatrix} = - \begin{bmatrix} m[0] \\ m[1] \\ \vdots \\ \vdots \\ \vdots \\ \vdots \\ m[L_m-1] \end{bmatrix}$$

$L_g$ is the matrix length of g[k], $L_c$ is the matrix length of c[k], and $L_m$ is the matrix length of m[k]. Wherein, $L_m=L_g+L_c-1$. As the matrix g[k] is a full column rank, the problem as mentioned above becomes an over-determined problem. It is usually difficult to find an exact solution in terms of this problem. Explained from a mathematical perspective, an over-determined problem is usually unsolvable, so only approximate solutions can be found. Therefore, the conventional method is intended to find the optimal approximate solution to minimize the error to the least. However, a non-zero residual error may be generated somehow. That is, the non-zero residual noise is generated, which may limit the noise-cancelling effect.

To solve the problem as mentioned above, the present embodiment provides multi-channel noise-cancelling speakers. Wherein the equation (1) may be converted into the relation as shown in the equation (3):

$$G_1c_1 + G_2c_2 + \ldots + G_Nc_N = [G_1\ G_2\ \ldots\ G_N] \begin{bmatrix} c_1 \\ c_2 \\ \vdots \\ c_N \end{bmatrix} = Gc = -m \quad (3)$$

Wherein, $G=[G_1\ G_2\ \ldots\ G_N] \in \mathbb{R}^{L_m \times NL_c}$ is an impulse response matrix of each of the noise-cancelling audio frequencies and $$c = \begin{bmatrix} c_1 \\ c_2 \\ \vdots \\ c_N \end{bmatrix} \in \mathbb{R}^{NL_c}$$

is a control coefficient matrix of each of the controllers. m is the impulse response matrix of the primary path, Lm is a matrix length of m, Lc is the matrix length of c, and N is the number of the plurality of noise-cancelling speakers. Through increasing the number of the noise-cancelling speakers, the dimension of the matrix G is increased. When the length Lc of the chosen controller satisfies $(N-1)L_c \geq L_y-1$, the aforementioned problem becomes an under-determined problem. Not only is the under-determined problem definitely solvable in a mathematical perspective, but also this problem has infinite solutions, or infinite exact solutions, to be more precise. Therefore, infinite exact solutions may be obtained regarding this problem. Because the obtained solutions are not approximate solutions, residual noise may not be generated. Therefore, zero residual noise may be achieved, thereby increasing the noise-cancelling effect. In addition, under the condition of $(N-1)L_c=L_g-1$, that is, when the equation holds, matrix G is a square matrix, and matrix c may further be simplified into $c=-G^{-1}m$. From this, the control coefficient matrix of each of the controllers may be obtained.

Figure 2:
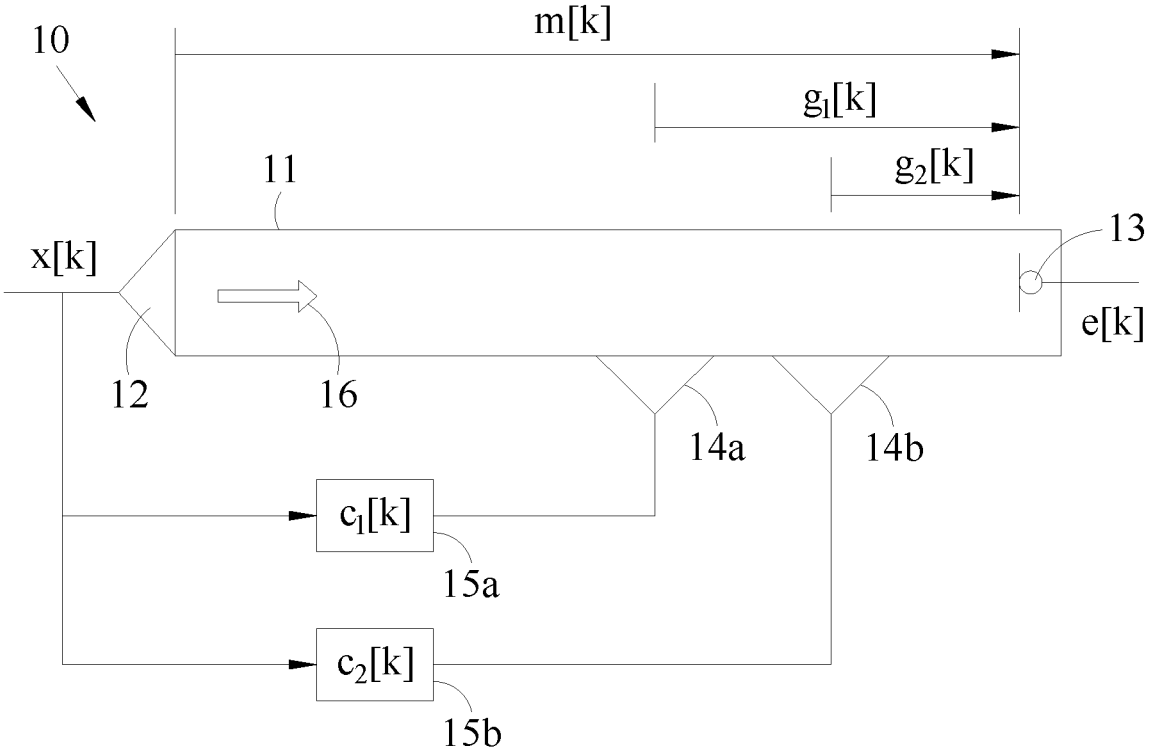
FIG. 2 is a schematic diagram of the active duct noise control system of the other embodiment in the present disclosure.

Please refer to FIG. 2, illustrating the schematic diagram of the active duct noise control system of the other embodiment in the present disclosure. As shown, the active duct noise control system 10 includes a duct 11, a noise source speaker 12, a microphone 13, a first noise-cancelling speaker 14*a*, a second noise-cancelling speaker 14*b*, a first controller 15*a*, and a second controller 15*b*. Firstly, the duct 11 refers to the route for audio transmission. In this embodiment, a square wooden duct with a cross-sectional area (16 cm multiplied by 16 cm) is chosen. However, the present disclosure is not limited therein. Circular shapes or other material may also be chosen to produce the duct as the route for audio transmission. A noise source speaker 12 is disposed on one end of the duct 11. The noise source speaker 12 receives the reference signal x[k] to make the primary noise 16. The microphone 13 is disposed on the other end of the duct 11 to receive the residual noise after the primary noise 16 passes through the duct. As shown in the previous embodiment, for the purpose of decreasing the residual noise to the lowest, that is, making the error signal e[k] approach zero, the audio frequencies generated by a plurality of noise-cancelling speakers in the duct 11 are used to offset the primary noise.

In this embodiment, two-channel noise-cancelling speakers are disposed in the active duct noise control system 10, namely a first noise-cancelling speaker 14*a* and a second noise-cancelling speaker 14*b*. As shown, the first noise-cancelling speaker 14*a* is disposed closer to the noise source speaker 12 compared to the second noise-cancelling speaker 14*b*. However, the present disclosure is not limited herein. The distance from the noise-cancelling speakers to the noise source speaker 12 or to the microphone 13 may vary depending on the number of dispositions. The first controller 15*a* is connected to the first noise-cancelling speaker 14*a* to control the generated noise-cancelling source, whereas the second controller 15*b* is connected to the second noise-cancelling speaker 14*b* to control the generated noise-cancelling source. The first controller 15*a* and the second controller 15*b* are both connected to the noise source speaker 12 and receive the same reference signal x[k]. Through the controllers and according to the impulse response m[k] of the noise source speaker 12 and the impulse responses $g_1$[k] and $g_2$[k] generated by the first noise-cancelling speaker 14*a* and the second noise-cancelling speaker 14*b*, the control coefficient $c_1$[k] and $c_2$[k] of the first controller 15*a* and the second controller 15*b* are calculated. The first controller 15*a* and the second controller 15*b* may be implemented on the computer device including the Input/Output interface, memory and processor. The first controller 15*a* and the second controller 15*b* may also be implemented on the digital signal processor (DSP).

In addition, the active duct noise control system 10 in the present embodiment may further dispose a spectrum analyzer. For instance, a sampling frequency at 16 kHz is used to detect the impulse response m[k] of the primary path and the impulse responses $g_1$[k] and $g_2$[k] of the secondary path. Wherein, the dual-channel test result in the embodiment may be illustrated according to the following diagrams.

Figure 3A:
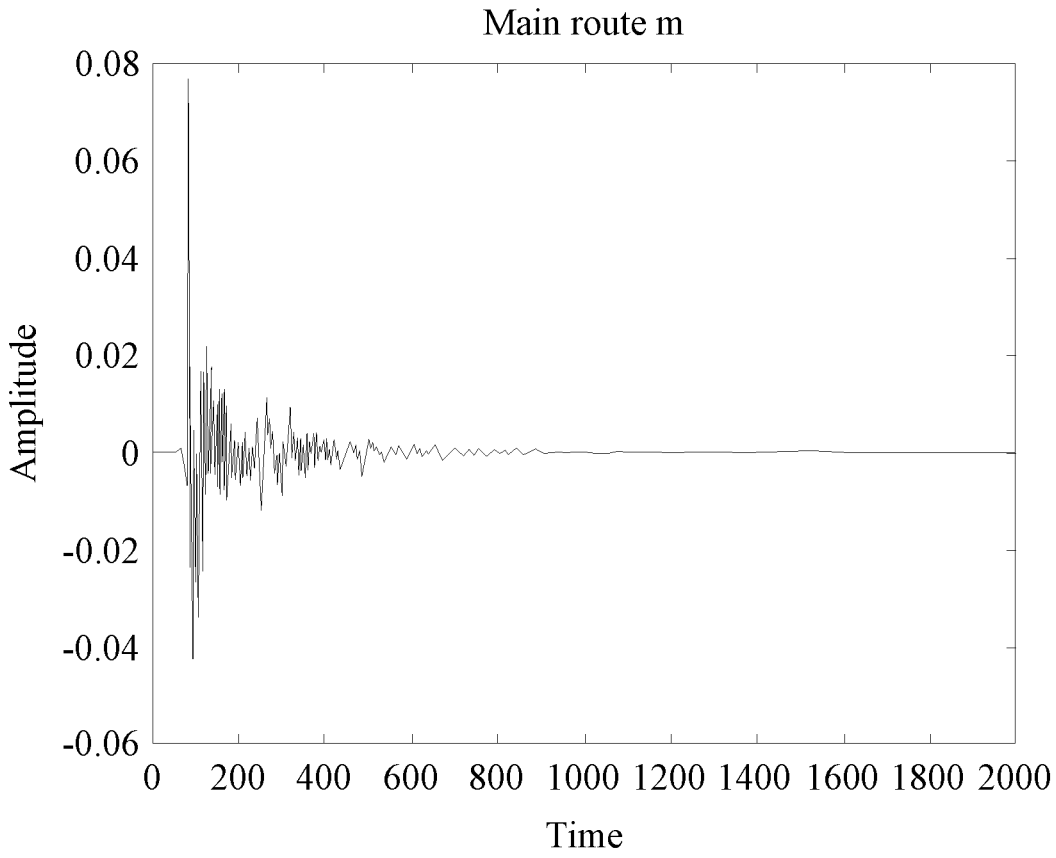
FIG. 3A is a schematic diagram of the impulse response of the primary path of an embodiment in the present disclosure.
Figure 3B:
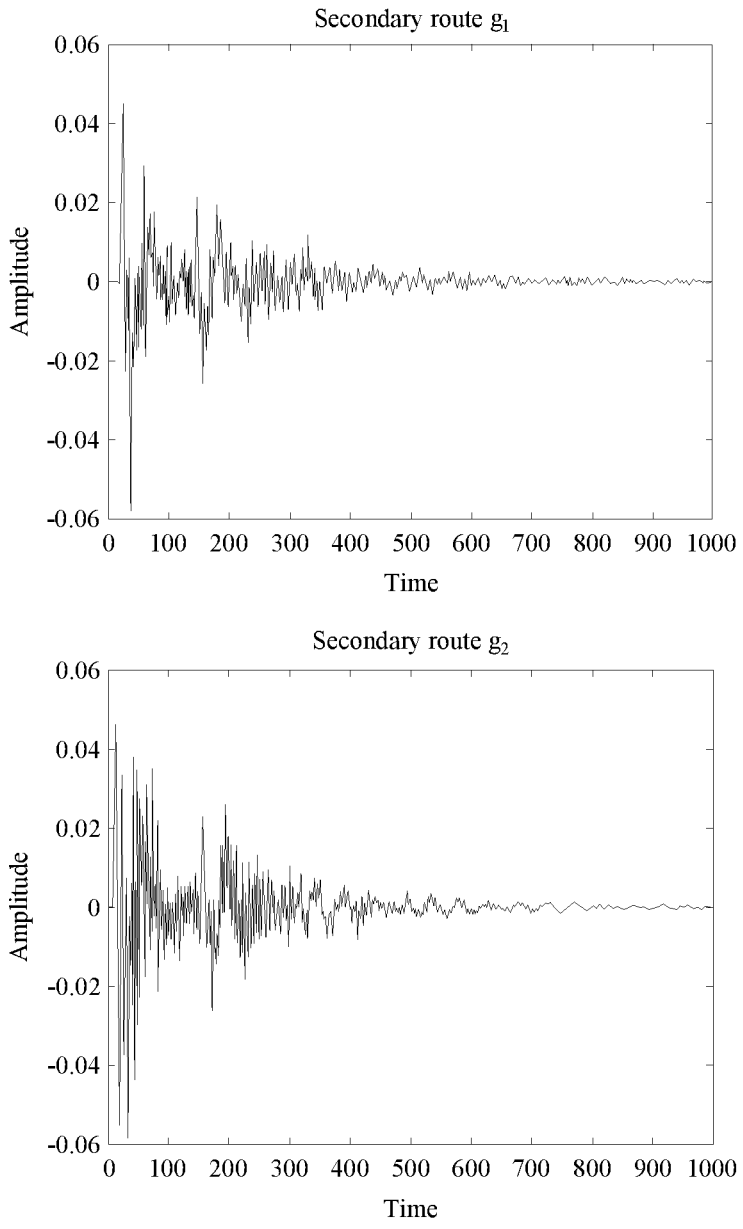
FIG. 3B is a schematic diagram of the impulse response of the secondary path of an embodiment in the present disclosure.

Please refer to FIG. 3A and FIG. 3B. FIG. 3A is the schematic diagram of the impulse response of the primary path of the embodiment in the present disclosure. FIG. 3B is the schematic diagram of the impulse response of the secondary path of the embodiment in the present disclosure. As shown, the noise source speaker of the primary path after sampling has an impulse shown in the diagram. Wherein, the matrix length of $L_m$ is 2000. In terms of the noise-cancelling speakers, the impulse response obtained from the first noise-cancelling speaker 14*a* is shown as the secondary path $g_1$ on the left side of FIG. 3B. Likewise, the impulse response obtained from the second noise-cancelling speaker 14*b* is shown as the secondary path $g_2$ on the right side of FIG. 3B. In the embodiment, the matrix length of $L_{g1}$ and $L_{g2}$ is 1000.

After the simulation, the control coefficients of the first controller 15*a* and the second controller 15*b* may further be found. With the use of the back calculation result, the noise-cancelling effect of the active duct noise control system 10 may effectively be improved. Wherein, the active duct noise control method is illustrated in the following embodiment.

Figure 4:
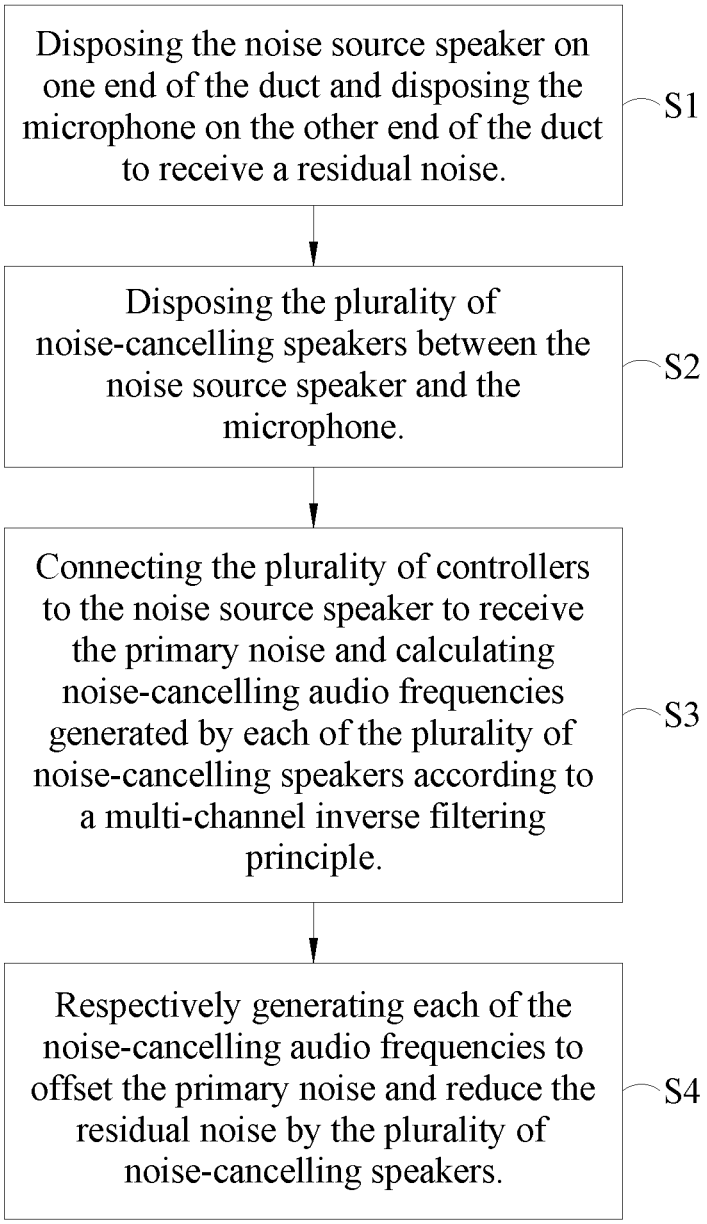
FIG. 4 is a flow chart of the active duct noise control method of an embodiment in the present disclosure.

Please refer to FIG. 4, illustrating the flow chart of the active duct noise control method of the embodiment in the present disclosure. The active duct noise control method of the embodiment is applicable to the active duct noise control system of the previous embodiment. The same elements in the system are denoted by the same symbols. Thus, the same content shall not be described repeatedly. As shown, the active duct noise control method includes the following steps (S1 to S4):

Step S1: disposing the noise source speaker on one end of the duct and disposing the microphone on the other end of the duct to receive a residual noise. Please refer to FIG. 2. The active duct noise control system 10 is disposed first. A noise source speaker 12 is disposed on one end of the duct 11. The noise source speaker 12 receives the reference signal x[k] to make the primary noise 16. The microphone 13 is disposed on the other end of the duct 11 to receive the residual noise after the primary noise 16 passes through the duct.

Step S2: disposing the plurality of noise-cancelling speakers between the noise source speaker and the microphone. The first noise-cancelling speaker 14*a* and the second noise-cancelling speaker 14*b* are disposed in the duct 11 and located between the noise source speaker 12 and the microphone 13. The embodiment is illustrated on the basis of the disposition of the two noise-cancelling speakers with the dual channels. However, the present disclosure is not limited therein. Disposing more than two noise-cancelling speakers with multiple channels is also included in the present disclosure.

Step S3: connecting the plurality of controllers to the noise source speaker to receive the primary noise and calculating noise-cancelling audio frequencies generated by each of the plurality of noise-cancelling speakers according to a multi-channel inverse filtering principle. The first controller 15*a* is connected to the first noise-cancelling speaker 14*a*, whereas the second controller 15*b* is connected to the second noise-cancelling speaker 14*b*. In the meantime, the first controller 15*a* and the second controller 15*b* are connected to the noise source speaker 12 to receive the same reference signal x[k]. According to the multi-channel inverse filtering principle, the control coefficients $c_1$[k] and $c_2$[k] of the first controller 15*a* and the second controller 15*b* are calculated.

Step S4: respectively generating each of the noise-cancelling audio frequencies to offset the primary noise and reduce the residual noise by the plurality of noise-cancelling speakers. The first noise-cancelling speaker 15*a* controls the noise-cancelling source generated by the first noise-cancelling speaker 14*a*, whereas the second noise-cancelling speaker 15*b* controls the noise-cancelling source generated by the second noise-cancelling speaker 14*b*. The primary noise may be offset by the noise-cancelling source when passing through the duct 11 to decrease the residual noise to the lowest to achieve the active noise-cancelling effect.

Figure 5A:
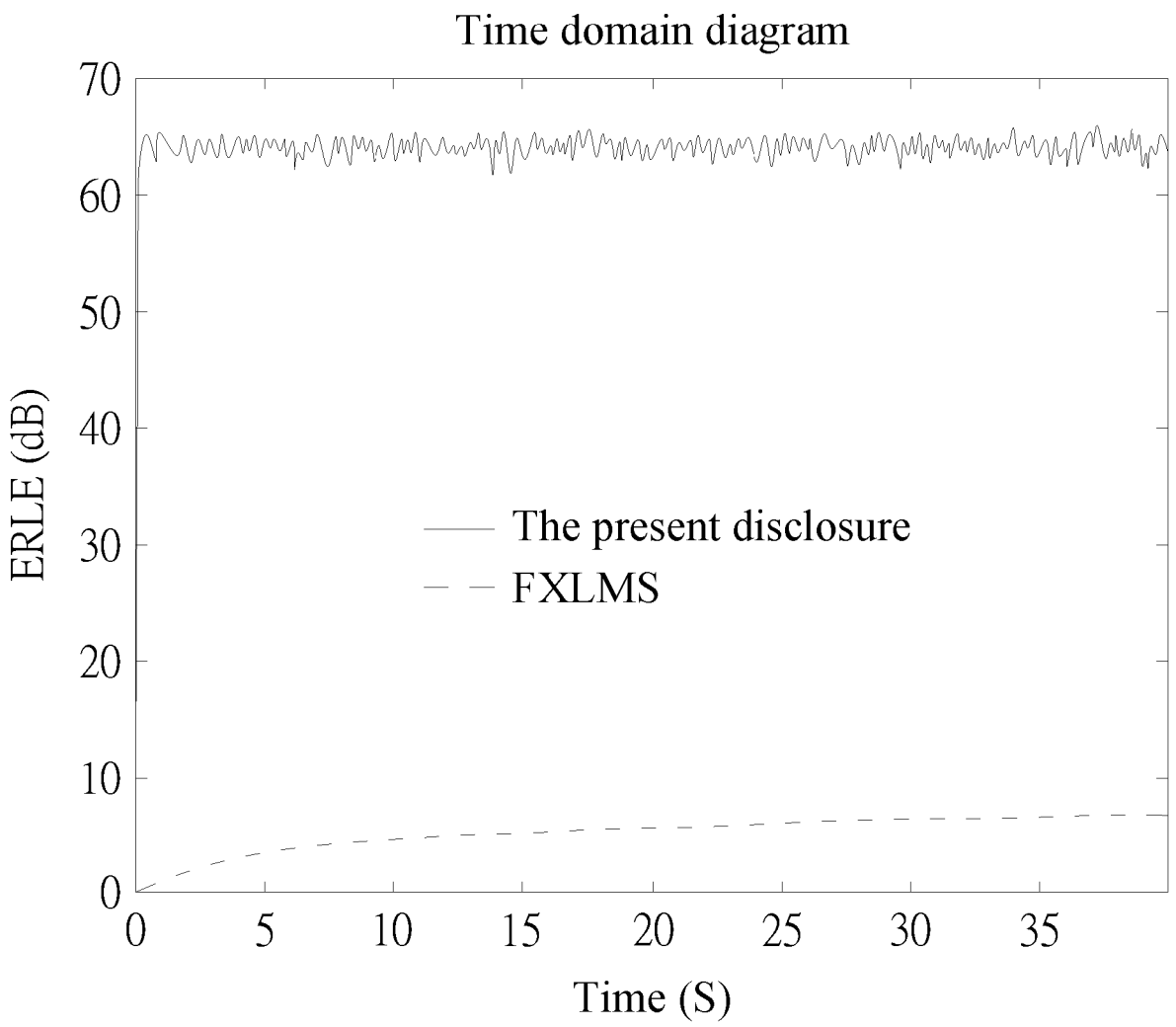
FIG. 5A and FIG. 5B are comparative diagrams between the conventional techniques and the active duct noise control method of an embodiment in the present disclosure.
Figure 5B:
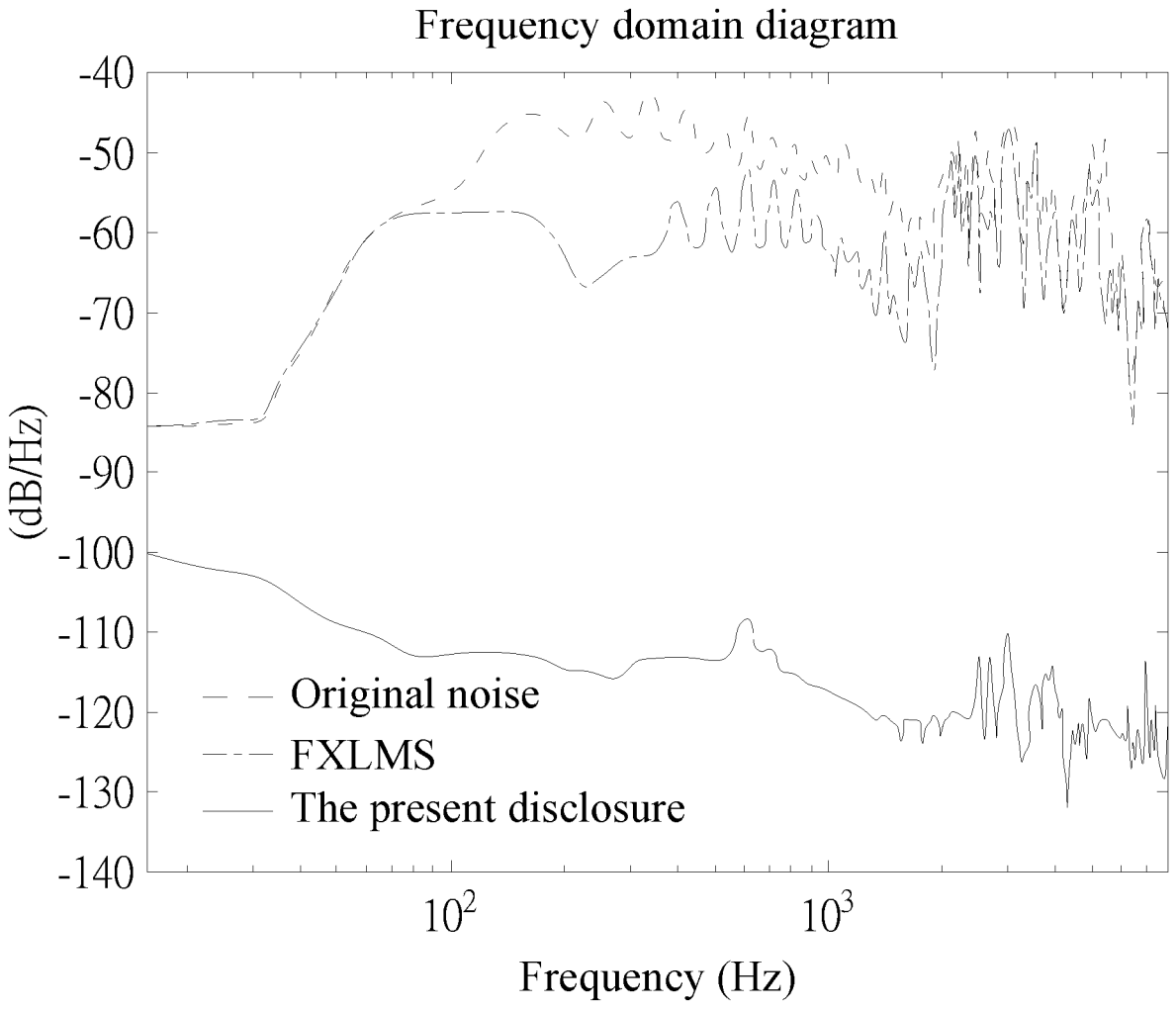

The result of the comparison between the embodiment of the active duct noise control system and the method thereof and that of the conventional active noise-cancelling method is illustrated in the fowling figures. Please refer to FIG. 5A and FIG. 5B. FIG. 5A and FIG. 5B are the comparative diagrams between the conventional techniques and the active duct noise control method of the embodiment in the present disclosure. In the embodiment, for the conventional techniques, the FXLMS algorithm is chosen to perform tests and the second noise-cancelling speaker as in FIG. 2 is adopted. The differences between the active duct noise control and the conventional techniques are tested based on time and frequency as the horizontal axis. As shown in FIG. 5A illustrating a time domain diagram, ERLE (Echo Return Loss Enhancement) value in the present disclosure is apparently superior to the FXLMS algorithm in all time periods. The ERLE value is defined as the ratio of the noise energy before the control is performed to the residual noise energy after the control is performed. The larger the value is, the better the noise-cancelling effect will be. In comparison with the conventional method of the active noise-cancelling effect, the method of the present disclosure may enhance the noise-cancelling effect more effectively.

Furthermore, please refer to FIG. 5B illustrating a frequency domain diagram. The original noise is presented on the top. In some frequency bands, the conventional FXLMS method may be able to reduce the original noise for 15 dB to the most approximately. However, in some other frequency bands, the reducing amplitude is not obvious. In contrast, for the noise-cancelling effect achieved by the system and the method in the present disclosure, the frequency band for noise reduction is between 100 Hz and 2 kHz, or 60 dB to the most. Moreover, the noise reduction is a full bandwidth, showing that the active noise-cancelling method of the present disclosure has a wider noise-cancelling range and a better noise-cancelling effect compared to the conventional active noise-cancelling method.

What is stated above is only illustrative examples which do not limit the present disclosure. Any spirit and scope without departing from the present invention as to equivalent modifications or alterations is intended to be included in the following claims.

What is claimed is:

1. An active duct noise control system, comprising:

a duct;

a noise source speaker, disposed on one end of the duct and generating a primary noise;

a microphone, disposed on the other end of the duct and receiving a residual noise;

a plurality of noise-cancelling speakers, disposed between the noise source speaker and the microphone and respectively generating noise-cancelling audio frequencies to offset the primary noise and reduce the residual noise; and a plurality of controllers, respectively connected to the plurality of noise-cancelling speakers and the noise source speaker and calculating each of the noise-cancelling audio frequencies generated by each of the plurality of noise-cancelling speakers according to a multi-channel inverse filtering principle;

wherein the multi-channel inverse filtering principle satisfies an equation $g_1[k]*c_1[k]+g_2[k]*c_2[k]+\ldots+g_N[k]*c_N[k]+m[k]=0$;

wherein m[k] is an impulse response of a primary path, $g_i[k]$ is the impulse response of a secondary path, and $c_i[k]$ is a control coefficient of each of the controllers: i=1, 2, . . . , N, N is the number of each of the noise-cancelling speakers, and * is a linear convolution operation;

wherein the equation is converted into a relation in a matrix form:

$$G_1c_1+G_2c_2+\ldots+G_Nc_N=[G_1\ G_2\ \ldots\ G_N]\begin{bmatrix}c_1\\c_2\\\vdots\\c_N\end{bmatrix}=Gc=-m;$$

wherein $G=[G_1\ G_2\ \ldots\ G_N]\in\mathbb{R}^{L_m\times NL_c}$ is an impulse response matrix of each of the noise-cancelling audio frequencies and $$c=\begin{bmatrix}c_1\\c_2\\\vdots\\c_N\end{bmatrix}\in\mathbb{R}^{NL_c}$$

is a control coefficient matrix of the secondary path: m is the impulse response matrix of the primary path, $L_m$ is a matrix length of m, $L_c$ is the matrix length of c, and N is the number of the plurality of noise-cancelling speakers.

2. The active duct noise control system according to claim 1, wherein Lg is the matrix length of G, and when $(N-1)L_c\geq L_g-1$ is satisfied, a control coefficient of each of the plurality of controllers has a corresponding solution to control the noise-cancelling audio frequencies respectively generated by the plurality of noise-cancelling speakers.

3. The active duct noise control system according to claim 1 further comprising a spectrum analyzer connected to the noise source speaker and the plurality of noise-cancelling speakers and sampling the impulse response in the duct.

4. A active duct noise control method applicable to controlling a primary noise generated by a noise source speaker in a duct, wherein the duct comprises a plurality of noise-cancelling speakers, a plurality of controllers which control the plurality of noise-cancelling speakers, and a microphone; the active duct noise control method comprises the following steps:

disposing the noise source speaker on one end of the duct and disposing the microphone on the other end of the duct to receive a residual noise;

disposing the plurality of noise-cancelling speakers between the noise source speaker and the microphone;

connecting the plurality of controllers to the noise source speaker to receive the primary noise and calculating noise-cancelling audio frequencies generated by each of the plurality of noise-cancelling speakers according to a multi-channel inverse filtering principle; and respectively generating each of the noise-cancelling audio frequencies to offset the primary noise and reduce the residual noise by the plurality of noise-cancelling speakers;

wherein the multi-channel inverse filtering principle satisfies an equation $g_1[k]*c_1[k]+g_2[k]*c_2[k]+\ldots+g_N[k]*c_N[k]+m[k]=0$;

wherein m[k] is an impulse response of a primary path, $g_i[k]$ is the impulse response of a secondary path, and $c_i[k]$ is a control coefficient of each of the controllers: i=1, 2, . . . , N, N is the number of each of the noise-cancelling speakers, and * is a linear convolution operation;

wherein the multi-channel inverse filtering principle satisfies an equation $g_1[k]*c_1[k]+g_2[k]*c_2[k]+\ldots+g_N[k]*c_N[k]+m[k]=0$;

wherein the equation is converted into a relation in a matrix form:

$$G_1c_1+G_2c_2+\ldots+G_Nc_N=[G_1\ G_2\ \ldots\ G_N]\begin{bmatrix}c_1\\c_2\\\vdots\\c_N\end{bmatrix}=Gc=-m;$$

wherein $G=[G_1\ G_2\ \ldots\ G_N]\in\mathbb{R}^{L_m\times NL_c}$ is an impulse response matrix of the secondary path and $$c=\begin{bmatrix}c_1\\c_2\\\vdots\\c_N\end{bmatrix}\in\mathbb{R}^{NL_c}$$

is a control coefficient matrix of each of the controllers: m is the impulse response matrix of the primary path, $L_m$ is a matrix length of m, $L_c$ is the matrix length of c, and N is the number of the plurality of noise-cancelling speakers.

5. The active duct noise control method according to claim 4, wherein Lg is the matrix length of G, and when $(N-1)L_c\geq L_g-1$ is satisfied, a control coefficient of each of the plurality of controllers has a corresponding solution to control the noise-cancelling audio frequencies respectively generated by the plurality of noise-cancelling speakers.

6. The active duct noise control method according to claim 4 further sampling the impulse response in the duct by a spectrum analyzer connected to the noise source speaker and the plurality of noise-cancelling speakers.

* * * * *